US010040037B2

(12) United States Patent
Chen

(10) Patent No.: US 10,040,037 B2
(45) Date of Patent: Aug. 7, 2018

(54) FOAM MATERIAL GENERATOR

(71) Applicant: Jiubin Chen, Zhangdian Zibo (CN)

(72) Inventor: Jiubin Chen, Zhangdian Zibo (CN)

( * ) Notice: Subject to any disclaimer, the term of this patent is extended or adjusted under 35 U.S.C. 154(b) by 0 days.

(21) Appl. No.: 15/526,034

(22) PCT Filed: Nov. 25, 2015

(86) PCT No.: PCT/CN2015/095568

§ 371 (c)(1),
(2) Date: May 11, 2017

(87) PCT Pub. No.: WO2016/082764

PCT Pub. Date: Jun. 2, 2016

(65) Prior Publication Data

US 2017/0312705 A1 Nov. 2, 2017

(30) Foreign Application Priority Data

Nov. 30, 2014 (CN) ..... 2014 1 0704185

(51) Int. Cl.
*B01F 7/10* (2006.01)
*B01F 3/04* (2006.01)
(Continued)

(52) U.S. Cl.
CPC ..... *B01F 3/04453* (2013.01); *B01F 7/008* (2013.01); *B01F 7/10* (2013.01);
(Continued)

(58) Field of Classification Search
CPC ..... B01F 7/10
(Continued)

(56) References Cited

U.S. PATENT DOCUMENTS 2,078,065 A * 4/1937 De Bethune ..... B01F 15/00012 366/264
2007/0258824 A1* 11/2007 Pacello ..... F04D 5/001 416/223 R
(Continued)

FOREIGN PATENT DOCUMENTS

CN 201644041 U 11/2010
CN 102847452 A 1/2013
(Continued)

OTHER PUBLICATIONS

Feb. 26, 2016 International Search Report issued with International Patent Application No. PCT/CN2015/095568.

*Primary Examiner* — David Sorkin
(74) *Attorney, Agent, or Firm* — Oliff PLC

(57) ABSTRACT

A foam material generator has a housing; transmission device on the housing; housing cavity within the housing; pressurizing stirring foaming wheel within the cavity; transmission device transmission shaft connected to the wheel; pressurizing stirrers on the wheel; pressurizing stirrer airflow-facing surface forms an inclined angle with a cross sectional surface in a wheel rotational axis direction; housing cavity inlet is on a cavity end, and a housing cavity outlet is on another end; encircling abrasive disc is on a cavity inner wall adjacent to the outlet; encircling abrasive disc inlet is at a encircling disc middle portion; vortex current abrasive foaming disc is on a wheel end adjacent to the encircling disc; vortex current abrasive foaming disc surface conforms to be in close proximity with an encircling disc surface; and vortex current abrasive foaming cavity is between the surfaces of the vortex current abrasive foam disc and encircling disc.

10 Claims, 10 Drawing Sheets

(51) Int. Cl.
*B01F 7/00* (2006.01)
*B01F 15/06* (2006.01)
*B01F 15/00* (2006.01)

(52) U.S. Cl.
CPC ..... *B01F 15/00331* (2013.01); *B01F 15/066* (2013.01); *B01F 2015/061* (2013.01)

(58) Field of Classification Search
USPC ..... 366/264, 302, 305–307, 317
See application file for complete search history.

(56) References Cited

U.S. PATENT DOCUMENTS

2010/0307665 A1 12/2010 McCutchen
2014/0086007 A1* 3/2014 Li ..... B01F 15/065
366/302

FOREIGN PATENT DOCUMENTS

CN 103877880 A 6/2014
JP H01189340 A 7/1989

* cited by examiner

FOAM MATERIAL GENERATOR

TECHNICAL FIELD

The present invention relates to the field of material production equipment, and specifically to a foam material generator, which can be used as foam material production equipment to produce a new foam material or new nano-foam material.

BACKGROUND ART

The existing foam material production equipment has many problems, such as foam materials with uniform bubbles can not be produced, and the size, distribution uniformity, quantity and volume fraction of bubbles can not be controlled. Especially, as the production technology of foam metal and foam glass is primitive and backward, high performance foam materials are not used as they are supposed to be, and are not produced at low cost or applied extensively. The existing technology can not produce more excellent materials such as nano-foam materials and foam metal glass. During the existing production of nano-materials, nano-particles are damaged, and the material performance is largely degraded. The existing material production generally lacks a key process of material production, that is, material bubbling. Generally, only the simple original crystalline structure of materials is utilized. The advantages of material bubbling and nanocrystallization are neglected. Material bubbling and nanocrystallization are inexorable trends.

SUMMARY

The present invention provides a foam material generator. With new foaming method and structure, the foam material generator fully utilizes fluid motion, and fully and uniformly mixes a gas and a melt by means of a mixing action provide by an eddy current. With relative movement, points in the eddy current have an interaction force with each other; fluid molecules in the eddy current have mutual friction, and a rolling friction force is produced. Through the eddy current, the bonded molecules or atoms are separated; the particles in the eddy current respectively form a self-moving individual with varying moving speed, and are gradually mixed in the eddy current. The eddy current stretches the melt, and separates the gas into tiny bubble particles; the bubble particles are uniformly distributed in the melt, thus forming foams with uniformly distributed bubble particles. The melt can be stretched into fibres or thin films with multiple singe molecules or atoms connected; the fibres or thin films are interconnected to form foams with bubbles; the wall of the bubbles can be a very thin wall or even be made into a thin film with single molecules or atoms connected. A necessary foam material can be formed after the foams are directly rolled, cast or blow-cast, and are cooled and solidified. Multiple foam materials can be made of different materials. A new nano-foam material can be produced. All bubbles of the material are nano-bubbles. The wall of the bubbles is thinner, and can be considered as a combination of nano-particles. The material is combined by natural condensation, which will not damage the nano-particles. The material is a real nano-material with many magic performances. A nano-foam glass material can be produced. The material is cheap, environment-friendly in production, resistant to aging, rust, corrosion and high temperature, high in strength and tenacity, machinable and weldable. It can almost be an all-purpose popular material, and can be used to replace multiple materials, thus largely saving material utilization amount, and extremely saving resources. A silicon oxide resource that abounds in nature can be fully utilized, so that a great number of low-cost, energy-saving, environment-friendly and high-quality materials can be obtained, the material resources can become very sufficient, and the material resource problem can be solved thoroughly. The material can be used to build a house, repair a road, make a car, manufacture an aircraft, build a castle in the air, make a machine, construct a kiln, make clothes, produce inorganic paper, control a desert or a river, enhance the environment, improve crop yield, build large-area facility agriculture, fill in the sea to grow grains, build a man-made land, and thoroughly control natural disasters such as windstorm, tsunami and hurricane, etc. The material can completely change human's life. It can be widely used for the daily life of people, and create a new world.

To realize the foregoing purpose, the present invention adopts the following technical scheme.

A foam material generator, comprising a housing and a transmission device, wherein the transmission device is disposed on the housing; a housing cavity is disposed in the housing; a supercharged stirring foaming wheel is disposed in the housing cavity; a transmission shaft of the transmission device is connected with the supercharged stirring foaming wheel; the supercharged stirring foaming wheel is provided with multiple supercharged stirrers; the windward side of the supercharged stirrers is at an angle of inclination to the rotary axial cross section of the supercharged stirring foaming wheel; a housing cavity inlet is disposed at one end of the housing cavity, and a housing cavity outlet is disposed at the other end of the housing cavity; an annular grinding disc is disposed on the inner wall of the housing cavity close to the housing cavity outlet; an annular grinding disc inlet is disposed in the middle part of the annular grinding disc; an eddy current grinding foaming disc is disposed at one end of the supercharged stirring foaming wheel close to the annular grinding disc; the surface of the eddy current grinding foaming disc is correspondingly adjacent to the surface of the annular grinding disc; and an eddy current grinding foaming cavity is disposed between the surface of the eddy current grinding foaming disc and the surface of the annular grinding disc.

A thermal insulation device is disposed on the outer wall of the housing cavity.

The bottom inner wall of the housing cavity is gradually elevated towards the housing cavity outlet.

A transmission device position regulating device is disposed between the housing and the transmission device.

A cooling runner device is disposed inside the transmission shaft.

The housing cavity outlet is provided with a flow regulating device.

The housing cavity inlet is provided with an intake flow regulating device.

The surface of the annular grinding disc is at an angle of inclination to the rotary cross section; the surface of the eddy current grinding foaming disc is correspondingly adjacent to the surface of the annular grinding disc.

A ring current grinding foaming wheel is disposed at one end of the supercharged stirring foaming wheel close to the housing cavity outlet; the periphery of the ring current grinding foaming wheel is correspondingly adjacent to the inner wall of the housing cavity; a ring current grinding foaming cavity is disposed between the periphery of the ring current grinding foaming wheel and the inner wall of the housing cavity.

One end of the supercharged stirring foaming wheel is connected with the transmission shaft of the transmission device, and the other end of the supercharged stirring foaming wheel is connected with a rotary stabilizing device.

The present invention has the following advantages: a new structure and a new mixing and foaming method are adopted; a gas is separated into tiny bubbles through the mixing and stretching actions of a moving eddy current on a fluid; the melt and the bubbles are fully and uniformly mixed to form foams; the foams are cooled and solidified to form a foam material with uniform and fine bubbles and uniform bubble arrangement; the foam material generator, serving as material production equipment, can produce a new foam material with higher strength; the material can be widely used for material industry, mechanical industry and construction industry, etc.; the foam material generator can produce a new nano-foam material; the material is a real nano-material with the advantages both nano-material and foam material and many magic material performances; a great number of low-cost, energy-saving, environment-friendly and high-quality materials can be obtained, the material resources can become very sufficient, and the material resource problem can be solved thoroughly; material nanocrystallization extremely improves material performance, and material bubbling extremely reduces resource utilization amount; the foam material is a composite material combining soft and hard materials, and can extremely expand material application scope and space.

DESCRIPTION OF EMBODIMENTS

Figure 1:
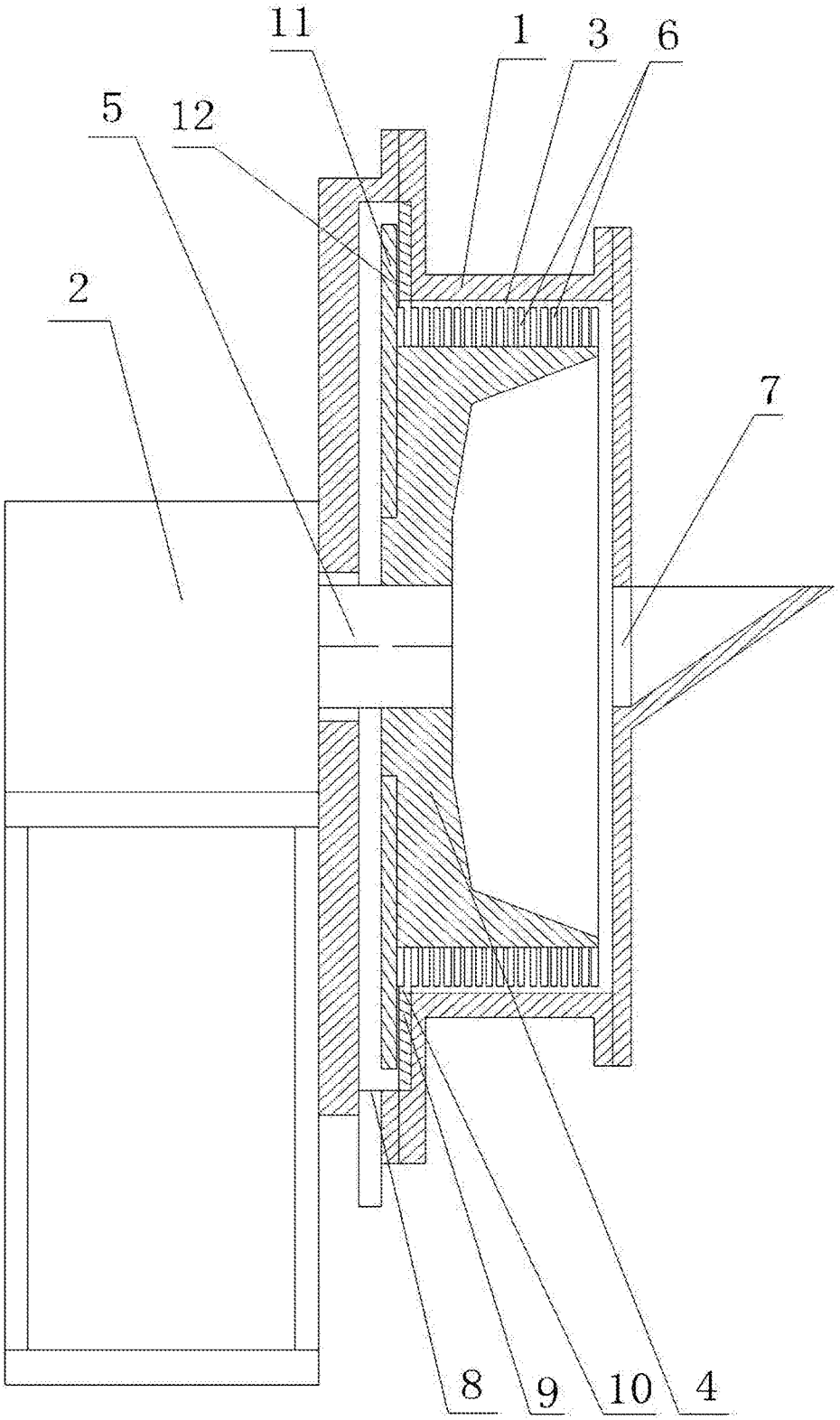
FIG. 1 is a schematic figure of a major structure of a foam material generator of the present invention.
Figure 2:
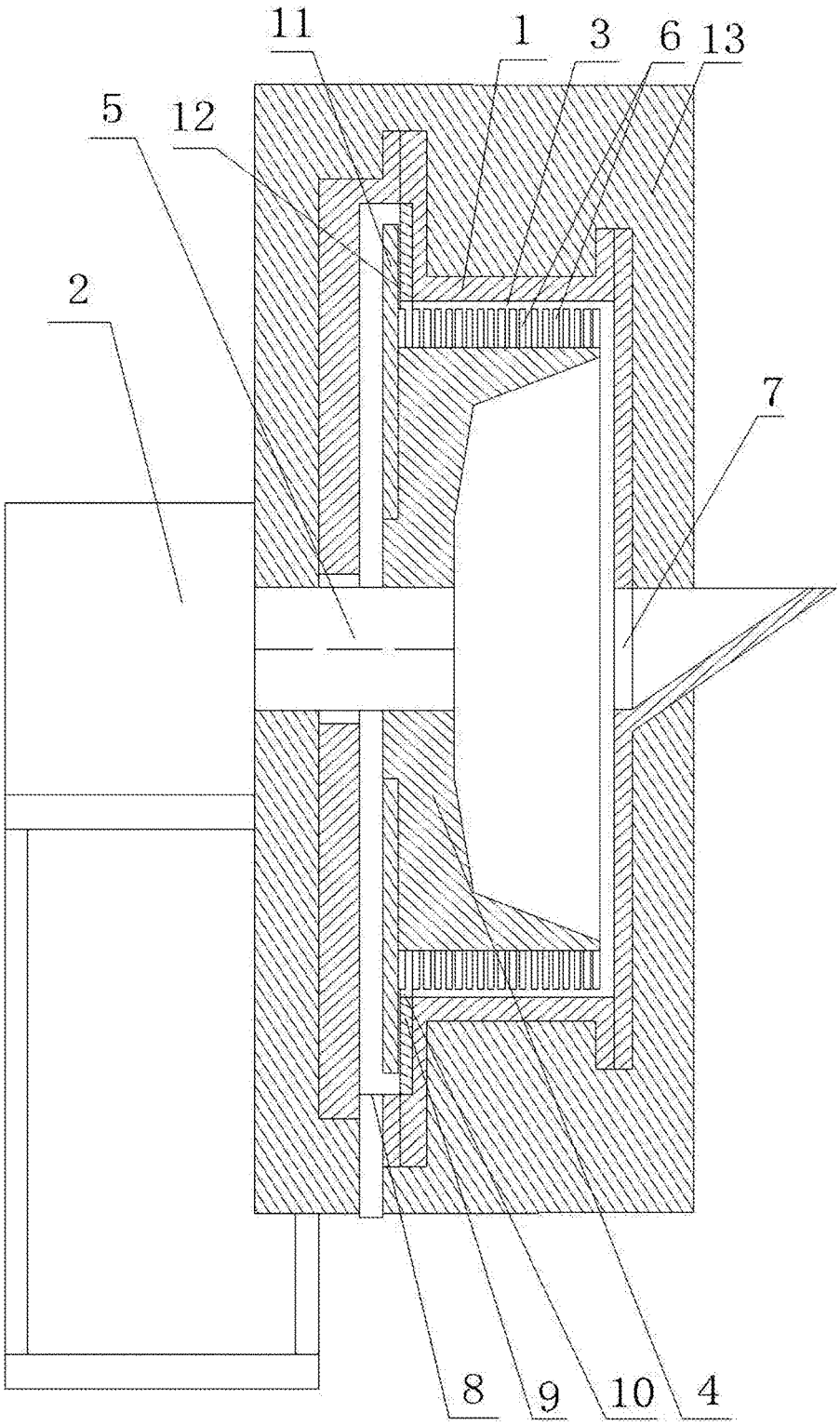
FIG. 2 is a schematic figure of a major structure of a first embodiment of a foam material generator of the present invention.
Figure 3:
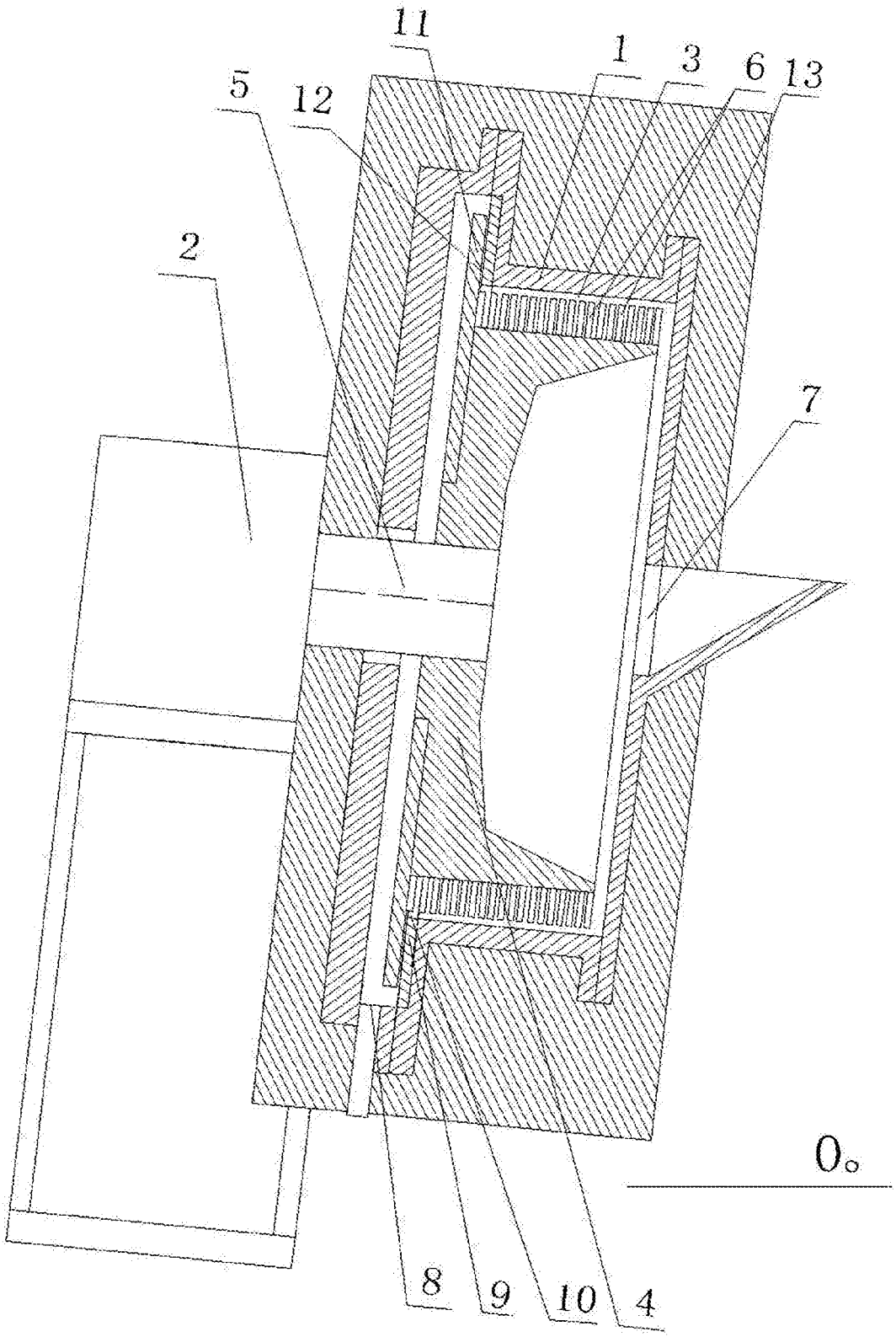
FIG. 3 is a schematic figure of a major structure of a second embodiment of a foam material generator of the present invention.
Figure 4:
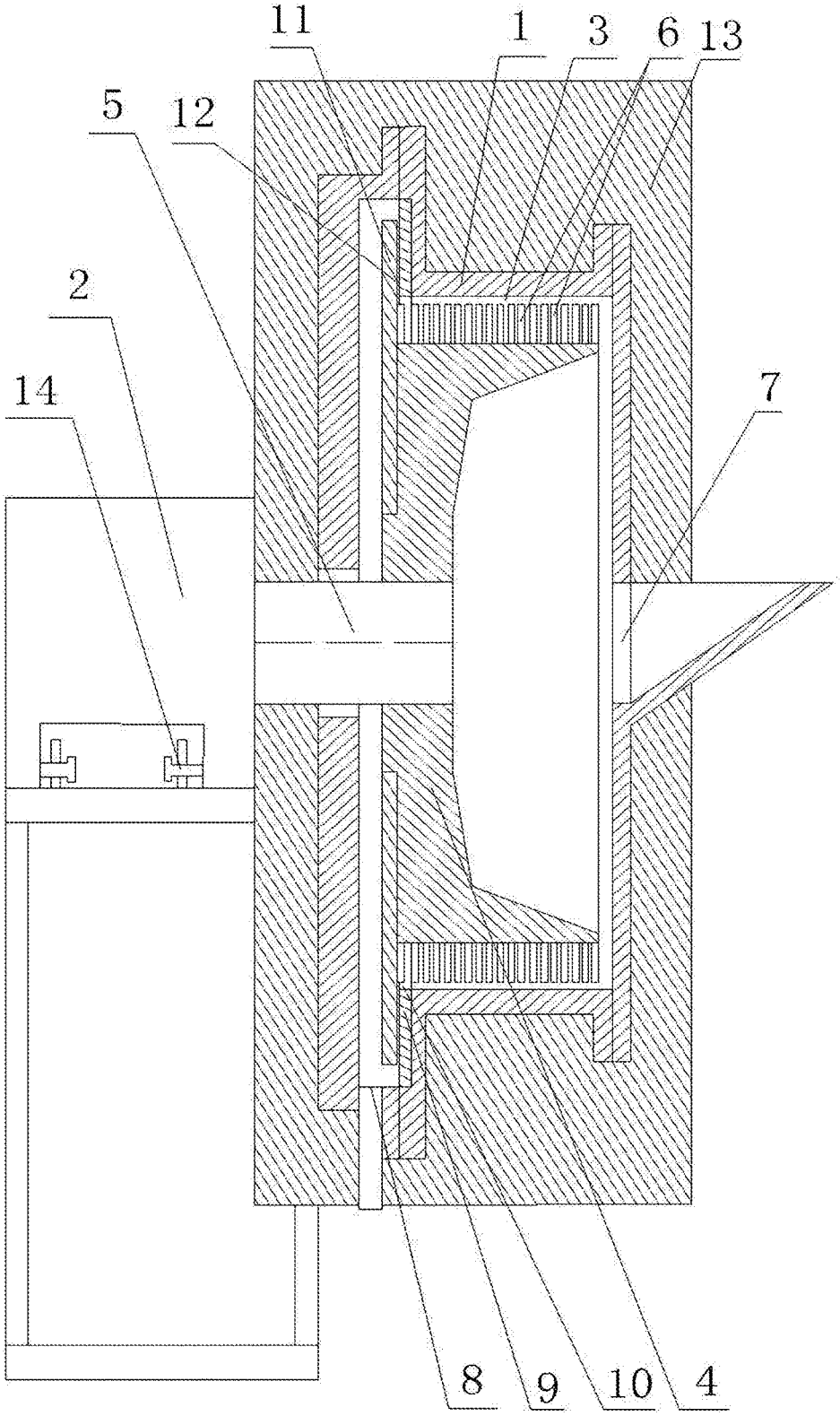
FIG. 4 is a schematic figure of a major structure of a third embodiment of a foam material generator of the present invention.
Figure 5:
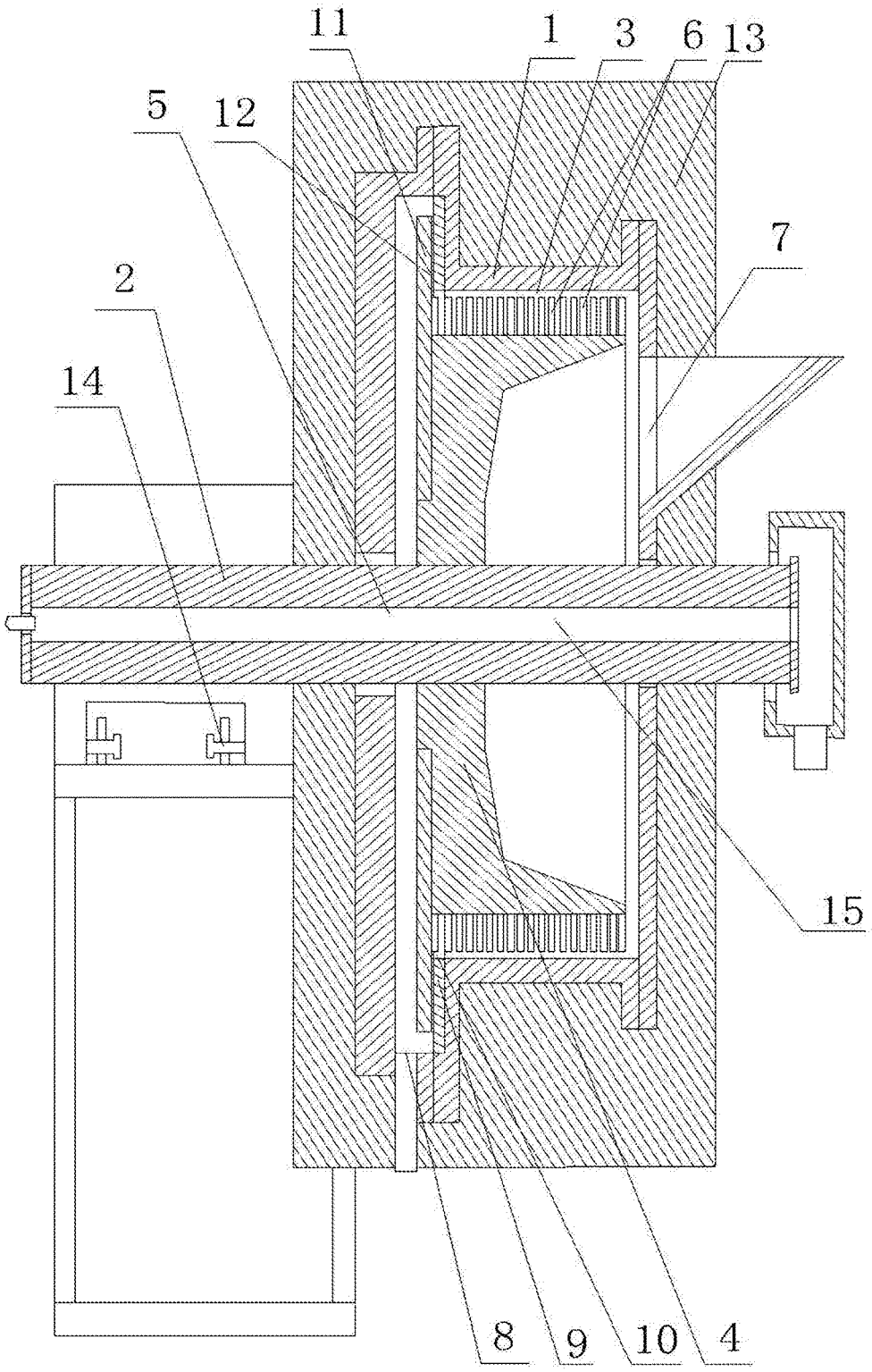
FIG. 5 is a schematic figure of a major structure of a fourth embodiment of a foam material generator of the present invention.
Figure 6:
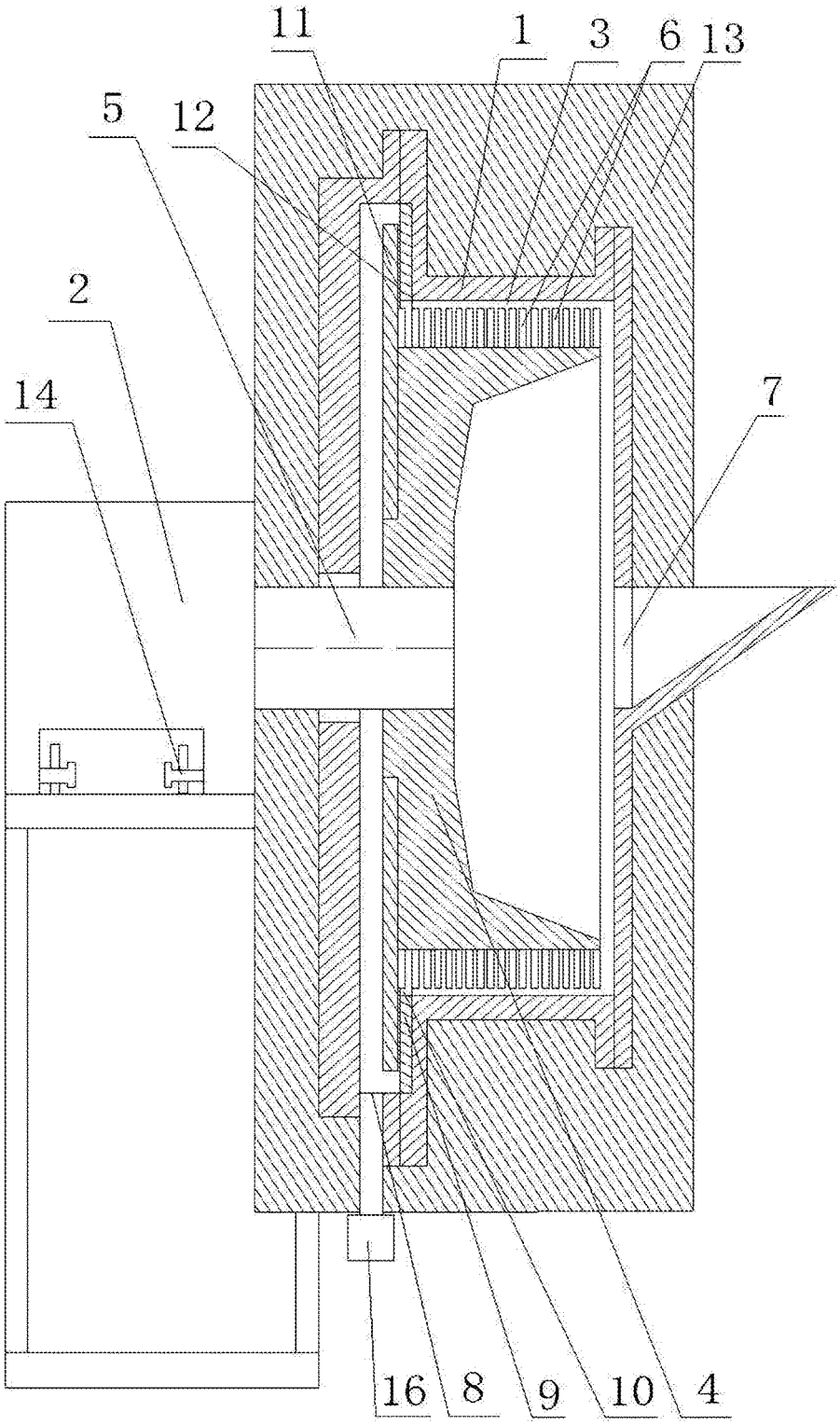
FIG. 6 is a schematic figure of a major structure of a fifth embodiment of a foam material generator of the present invention.
Figure 7:
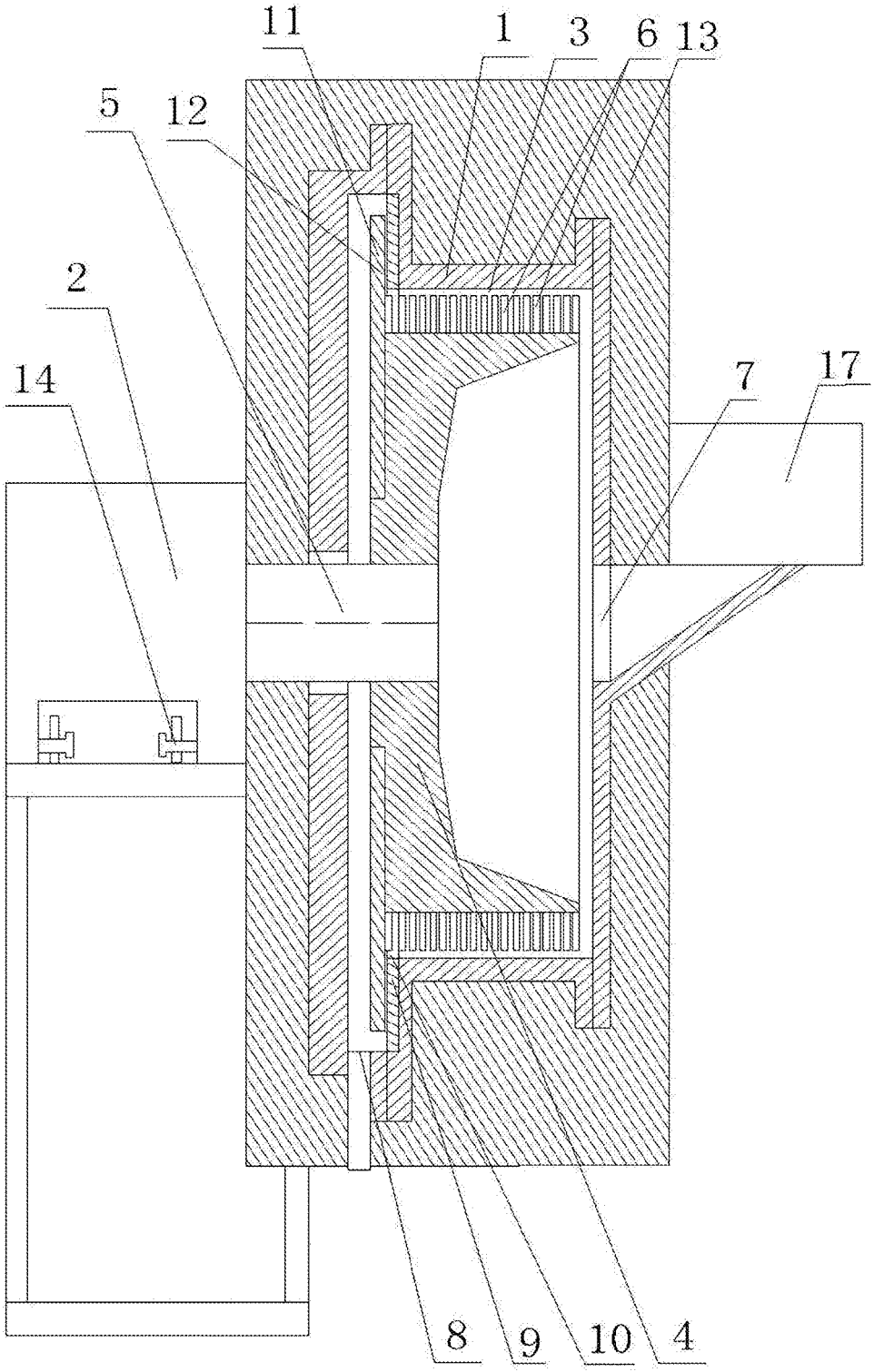
FIG. 7 is a schematic figure of a major structure of a sixth embodiment of a foam material generator of the present invention.
Figure 8:
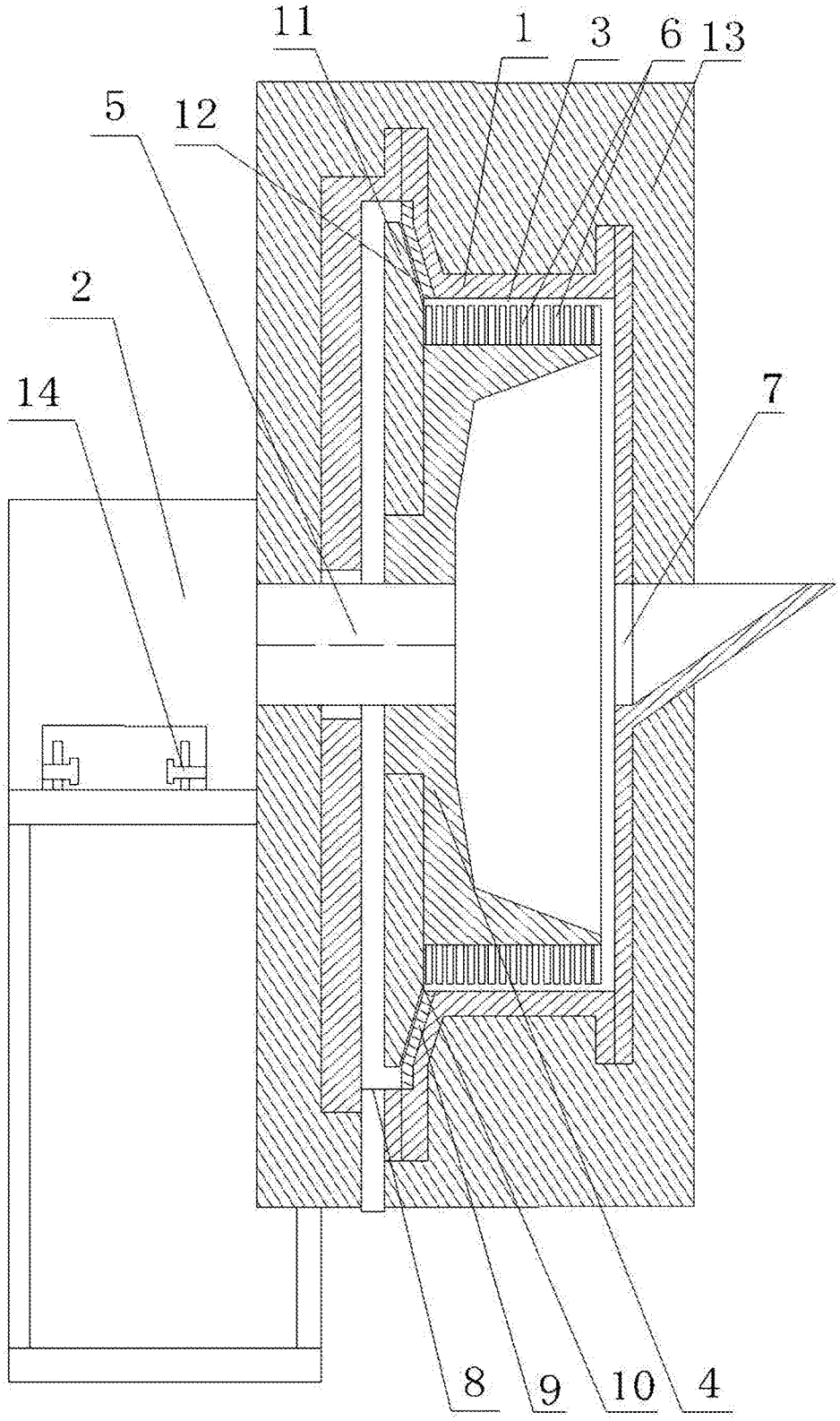
FIG. 8 is a schematic figure of a major structure of a seventh embodiment of a foam material generator of the present invention.
Figure 9:
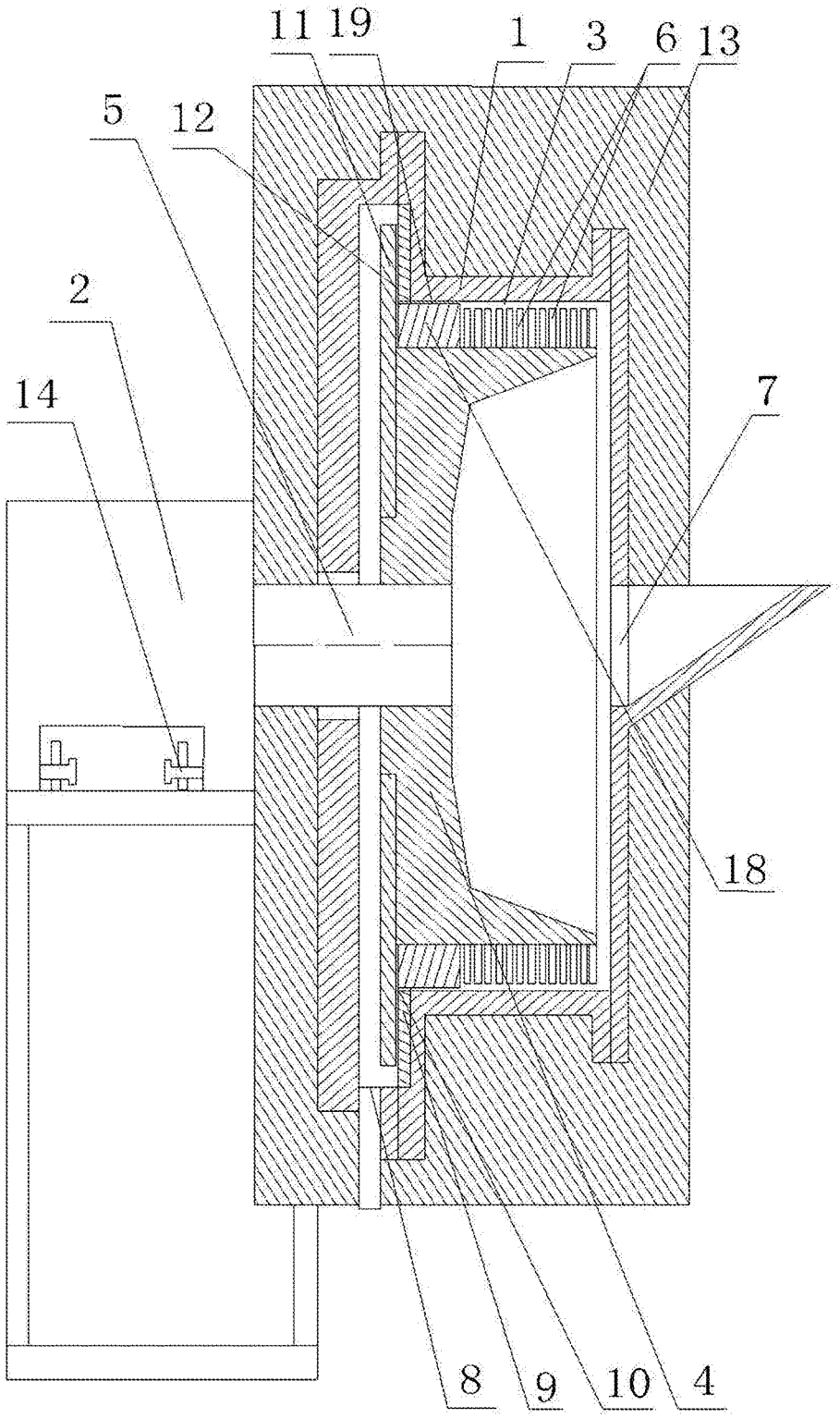
FIG. 9 is a schematic figure of a major structure of an eighth embodiment of a foam material generator of the present invention.
Figure 10:
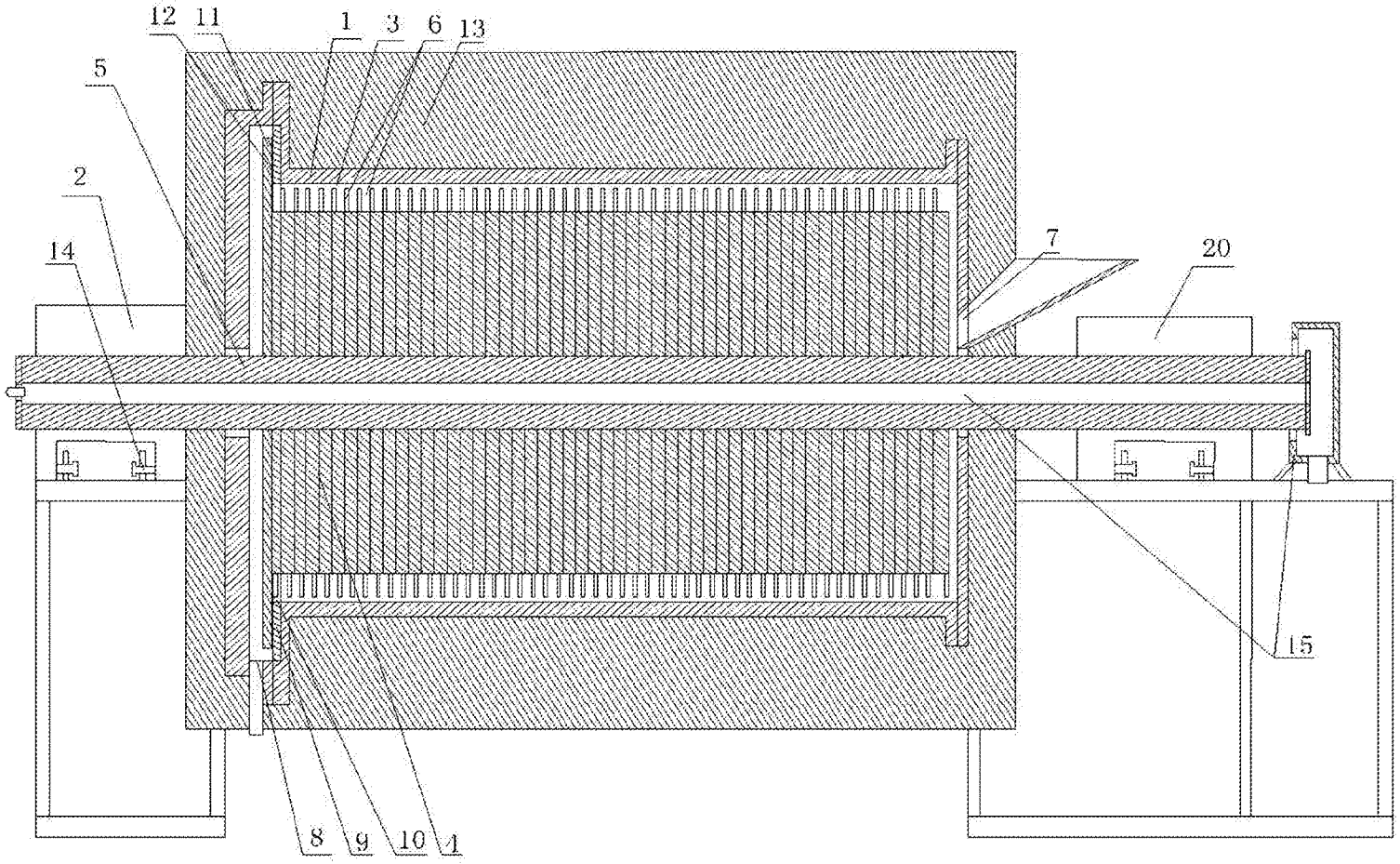
FIG. 10 is a schematic figure of a major structure of a ninth embodiment of a foam material generator of the present invention.

A major structure of a foam material generator of the present invention comprises a housing 1 and a transmission device 2, wherein the transmission device 2 is disposed on the housing 1; a housing cavity 3 is disposed in the housing 1; a supercharged stirring foaming wheel 4 is disposed in the housing cavity 3; a transmission shaft 5 of the transmission device 2 is connected with the supercharged stirring foaming wheel 4; the supercharged stirring foaming wheel 4 is provided with multiple supercharged stirrers 6; the windward side of the supercharged stirrers 6 is at an angle of inclination to the rotary axial cross section of the supercharged stirring foaming wheel 4; a housing cavity inlet 7 is disposed at one end of the housing cavity 3, and a housing cavity outlet 8 is disposed at the other end of the housing cavity 3; an annular grinding disc 9 is disposed on the inner wall of the housing cavity 3 close to the housing cavity outlet 8; an annular grinding disc inlet 10 is disposed in the middle part of the annular grinding disc 9; an eddy current grinding foaming disc 11 is disposed at one end of the supercharged stirring foaming wheel 4 close to the annular grinding disc 9; the surface of the eddy current grinding foaming disc 11 is correspondingly adjacent to the surface of the annular grinding disc 9; and an eddy current grinding foaming cavity 12 is disposed between the surface of the eddy current grinding foaming disc 11 and the surface of the annular grinding disc 9.

The housing 1 comprises a base, an enclosure and a protective cover, etc.; the housing 1 can be integrated with a power unit to form a complete housing.

The transmission device 2 comprises the transmission shaft, a bearing, a shaft seat, a support and the power unit, etc.; the transmission device 2 can adopt the transmission device and installation and connection method of an existing centrifugal fan or pump, and is connected with an equipment base; the transmission device 2 can adopt a conventional bearing; a cooling device can also be provided for cooling the transmission device 2, so that the bearing can run properly; the transmission shaft of the transmission device 2 can also be provided with a cooling device; the transmission shaft can be cooled by spraying water, so as to better ensure that the transmission device 2 runs properly; a circulating water cooling device can also be disposed on a transmission case of the transmission device, so as to better cool the bearing, etc.; the transmission shaft can also be provided with a thermal insulation material or device, so as to better ensure that the bearing runs properly and facilitate the connection between the transmission shaft end and the power unit for power input; the transmission shaft can also be made into a hollow shaft, inside which a cooling runner is disposed; the transmission shaft can be cooled by spraying water into the hollow shaft, so as to reduce a material requirement on the transmission shaft; specifically, the transmission shaft can be placed horizontally, vertically or obliquely as needed; the foaming effect can be improved when the transmission shaft is placed obliquely; the transmission shaft can be connected with the power unit to realize power input, so as to drive the foam material generator to work; the power unit can be a motor or an engine, etc.; the power unit can be directly connected with the transmission shaft, or be connected with the transmission shaft through a speed change gear or the transmission device, etc.; a belt, a chain, a gear and a coupler, etc. can be used for power input; the transmission shaft can also directly use the rotary shaft of the power unit, so that the power unit is connected with the transmission shaft, and the transmission device is integrated.

The transmission device 2 is provided on the housing 1; the transmission device 2 and the housing 1 can be directly made into an integral whole or be connected into an integral whole through various connection types; for a higher rotational speed, the transmission device 2 can adopt belt transmission; a belt pulley ratio can be regulated to change the speed; the transmission device can use a speed regulator; the flow and pressure of foams produced by the foam material generator can be regulated arbitrarily by regulating the rotational speed; the housing 1 can also be provided with a cooling device; a cooling water jacket can be disposed in the base to cool the base circularly, so as to better prevent the base from being deformed due to heat expansion.

The housing cavity 3 is disposed in the housing 1; the housing cavity 3 can be made into a cavity with round cross section; the housing cavity 3 can provide space for mixing a melt and a gas, foaming and supercharged; the housing cavity 3 can play a safety protection part in running the equipment runs more safely, disposing the thermal insulation device more conveniently, and running the equipment more reliably; the inner wall of the housing cavity 3 can be made of a wear-resisting material, a heat-resisting material, a heat-resisting thermal insulation material or a heat-resisting foam material; the inner wall of the housing cavity 3 can also be a wear-resisting or heat-resisting lining for a longer service life; the outer wall of the housing cavity 3 can also be covered with a thermal insulation material layer; the thermal insulation material layer can adopt a heat-resisting thermal insulation material or a thermal insulation cotton; meanwhile, through the thermal insulation material layer, the leak tightness between the transmission shaft and the housing can be improved; the thermal insulation material can prevent heat loss, so as to better ensure that the foam material generator runs properly; the housing cavity 3 can also be made of a heat-resisting foam material to have a thermal insulation effect; a heating unit can also be disposed inside the thermal insulation material layer for better thermal insulation and heating, so as to better ensure that the foam material generator runs properly; the heating unit can be an electric heating unit; a flame path or combustion chamber can also be disposed for fuel heating; an automatic temperature control device can also be adopted for better temperature control.

The supercharged stirring foaming wheel 4 is disposed in the housing cavity 3; the supercharged stirring foaming wheel 4 can simply be disposed on the central axis of the housing cavity 3, with a certain reasonable space between the periphery of the supercharged stirring foaming wheel and the inner wall of the housing cavity 3; it is better if the space is smaller, with reference to that between an impeller of the axial fan and the inner wall of the housing; under general conditions, the supercharged stirring foaming wheel 4 is made into an integral whole; the supercharged stirring foaming wheel 4 can be made into a hollow or solid structure; the structure of the supercharged stirring foaming wheel 4 can be simplified if solid structure is adopted; the cost of the supercharged stirring foaming wheel 4 can be lowered if hollow structure is adopted; multiple supercharged stirring foaming wheels 4 can also be separately disposed in the axial direction; they can be installed together on the transmission shaft; the supercharged stirring foaming wheel 4 can be made of different materials as needed; a high strength material can be adopted for a higher rotational speed; a heat-resisting high strength material can be adopted for higher temperature of to-be-foamed melt; a non-corrosive material can be adopted for a corrosive melt; the supercharged stirring foaming wheel 4 can be made of metal, ceramic, glass, carbon fibre, silicon carbide, heat-resisting stainless steel, heat-resisting alloy, tungsten-molybdenum alloy, tungsten alloy, graphite, foam materials, nano-foam materials or nano-materials, and can be made by means of casting, powder metallurgy, sintering, soldering, pressure casting and punch plug welding, etc.

The transmission shaft 5 of the transmission device 2 is connected with the supercharged stirring foaming wheel 4; to ensure balanced and stable rotation of the supercharged stirring foaming wheel 4, the transmission shaft 5 of the transmission device 2 is connected and fixed to the centre of the supercharged stirring foaming wheel 4; a wheel body can also be disposed in the middle part of the supercharged stirring foaming wheel 4, so as to better facilitate the connection between the supercharged stirring foaming wheel 4 and the transmission shaft; the transmission shaft 5 can also be integrated with the supercharged stirring foaming wheel 4; they can be integrated using a same material, so as to simplify the structure; however, the shortcoming is that the difficulty in the manufacturing process is increased; it is quite applicable if the supercharged stirring foaming wheel 4 is manufactured by means of powder metallurgy or sintering; if the temperature of the to-be-foamed melt is rather high, the transmission shaft 5 can adopt a heat-resisting high strength material, with reference to the manufacturing material of the supercharged stirring foaming wheel 4; if the supercharged stirring foaming wheel 4 has an excessive axial length of extension, the transmission device 2 can be disposed at both ends of the supercharged stirring foaming wheel 4 to stabilize the rotation of the supercharged stirring foaming wheel; the transmission devices 2 at both ends of the supercharged stirring foaming wheel 4 can be provided with a power unit for higher power input; the transmission device 2 at one end may be provided with a power unit, while the transmission device 2 at the other end may be provided with a bearing, instead of the power unit, to stabilize the rotation of the transmission shaft 5; a transmission device position regulating device can also be disposed between the housing 1 and the transmission device 2; the transmission device position regulating device can be provided with a screw and a nut, etc.; the transmission device position regulating device can be disposed on a mounting stand of the housing 1; the position of the transmission device 2 can be regulated by regulating the screw and the nut; the nut can be fixed on the mounting stand of the housing 1, while the screw can be regulated; two groups of regulating screws and nuts can be disposed for two-way regulation, so as to regulate the position of the transmission device 2 back and forth; the transmission device position regulating device can regulate the position of the supercharged stirring foaming wheel 4; it can regulate the axial position of the supercharged stirring foaming wheel 4, so as to better regulate the foaming effect and improve the foaming effect; a cooling runner device can also be disposed inside the transmission shaft 5; the transmission shaft 5 can be made into a hollow shaft, inside which a cooling runner device is disposed; the transmission shaft can be cooled by spraying a cooling liquid into the hollow shaft, so as to reduce a material requirement on the transmission shaft; the transmission shaft 5 can be prolonged, so that the two ends of the transmission shaft 5 can penetrate through the transmission device 2 and the housing cavity 3, respectively; thus, the two ends of the transmission shaft 5 stretch out to form a liquid inlet and a liquid outlet, respectively; the cooling runner device can be made with an inlet end area smaller than an outlet end area; the cooling liquid can flow out of the outlet end by making better use of the centrifugal force; the outlet end can be provided with a liquid receiver for receiving the cooling liquid; in this way, the cooling liquid returns back to a cooling device; after cooling, the cooling liquid is forced and sprayed into the transmission shaft 5, thus realizing circular cooling.

The supercharged stirring foaming wheel 4 is provided with multiple supercharged stirrers 6; the windward side of the supercharged stirrers 6 is at an angle of inclination to the rotary axial cross section of the supercharged stirring foaming wheel 4; the supercharged stirrers can be connected and fixed on the supercharged stirring foaming wheel through various connection types, and can be connected and fixed on the supercharged stirring foaming wheel 4 by peripheral and axial sporadic distribution; disordered air flow can be formed in the supercharged stirring foaming wheel 4 to intensify the impact between the supercharged stirrers 6 and the melt and the gas, so that the melt and the gas can be mixed sufficiently; the supercharged stirrers 6 can be made into various shapes, such as blade shape, cylinder shape, square column shape and triangle shape; the cross section of the supercharged stirrers 6 can be made into any shapes, such as rectangle shape, square shape, triangle shape, round shape, rhombus shape, drop shape and crescent shape; in this way, the air flow can be formed more disordered in the supercharged stirring foaming wheel 4, so that the gas and the melt are better stirred and evenly mixed, and the foaming effect is improved; the windward side of the supercharged stirrers 6 is at an angle of inclination to the rotary axial cross section of the supercharged stirring foaming wheel 4, so as to improve the axial moving speed of the gas, as well as the axial power capability of the supercharged stirrers 6 on the gas for better supercharging and axial acceleration on the gas; the angle of inclination between the windward side of the supercharged stirrers 6 and the rotary axial direction of the supercharged stirring foaming wheel 4 can be selected as needed; the angle of inclination between the windward side of respective supercharged stirrers 6 and the rotary axial cross section of the supercharged stirring foaming wheel 4 can vary to improve the impact between the gas and the melt; the supercharged stirrers 6 that are adjacent in the axial direction can also be staggered; thus, the impact of the supercharged stirrers 6 on the gas and the melt can be improved, the gas-gas impact can be improved, the supercharged stirrers 6 can better mix the melt and the gas, and the foaming of the material can be realized better; the supercharged stirrers 6 that are adjacent in the axial direction can also be disposed with a certain axial distance, so that the gas horizontally moves among the supercharged stirrers 6; as the horizontally moving gas impacts with the axially moving gas, the supercharged stirrers 6 can better impact on the gas and the melt, the gas-gas impact can be improved, the supercharged stirrers can better mix the melt and the gas, and better foaming can be realized; the melt is shaken under the rotary centrifugal force of the supercharged stirrers 6, and is constantly stirred and mixed with the gas for foaming in the periphery of the supercharged stirring foaming wheel 4; the foams axially flow under the supercharging action of the supercharged stirrers 6, and are eventually extruded out from the housing cavity 3; the foaming effect is better and the extrusion pressure of the foams is higher if the axial length of the supercharged stirring foaming wheel 4 is longer.

The housing cavity inlet 7 is disposed at one end of the housing cavity 3; one or more than one housing cavity inlet 7 can be disposed in the central area of one end of the housing cavity 3 to make better use of the centrifugal force to drive the melt and the gas into the housing cavity inlet 7; one or more than one housing cavity inlet 7 can also be disposed in the peripheral upper area of one end of the housing cavity 3 to facilitate the entrance of the melt; the housing cavity inlet 7 can also be provided with a melt guiding port; the melt guiding port can be disposed near the housing cavity inlet 7, so that the melt can automatically flow into the housing cavity inlet 7 more conveniently; a fuel nozzle can also be disposed near the housing cavity inlet 7 if a high temperature gas is used; the high temperature gas is formed by the ignition of a fuel sprayed by the fuel nozzle and a combustion-supporting gas; the high temperature gas is absorbed into the housing cavity inlet 7, and is eventually mixed with the melt; the housing cavity inlet 7 can also be provided with an intake flow regulating device; the intake flow regulating device can adopt a heat-resisting air hose, valve or ventilation door; it can better regulate intake blast capacity and better regulate the foaming effect.

The housing cavity outlet 8 is disposed at the other end of the housing cavity 3; the housing cavity outlet 8 can be arbitrarily disposed in the periphery or axial direction of the other end of the housing cavity 3; if the housing cavity outlet 8 is disposed in the periphery of the other end of the housing cavity, the pressure of the housing cavity outlet 8 can be improved by means of the centrifugal force; the outlet end of the housing cavity 3 can also be made into a volute shape; the housing cavity outlet 8 is disposed in the volute outlet, and the pressure of the housing cavity outlet 8 can be improved by means of the centrifugal force; when the inlet end of the housing cavity is provided with the transmission device 2, the housing cavity outlet 8 can also be disposed in the axial direction of the outlet end of the housing cavity 3, and the pressure of the housing cavity outlet 8 can be improved by means of the axial thrust produced by the supercharged stirring foaming wheel 4; the housing cavity 3 can be provided with one or more than one housing cavity outlet 8; constant flow and pressure of the foams can be realized when one housing cavity outlet 8 is disposed; when more than one housing cavity outlet 8 is disposed, more than one housing cavity outlet 8 with different areas can be disposed; according to the needs, a housing cavity outlet 8 can be selected to work, while other housing cavity outlets 8 are switched off, thus realizing different flow and pressure for the foams; the housing cavity outlet 8 can also be provided with a flow regulating device; the flow regulating device can adopt a heat-resisting valve or a detachable spout or nozzle with different calibres, etc.; the flow regulating device can better regulate the flow of the foams and the foaming effect; a heating unit can also be disposed in the housing cavity outlet 8; the heating unit can adopt a nozzle heating unit or an electric heating unit; the heating unit can better prevent the housing cavity outlet 8 from coking.

The annular grinding disc 9 is disposed on the inner wall of the housing cavity 3 close to the housing cavity outlet 8; the annular grinding disc 9 is simply annularly disposed on the housing cavity 3 close to the housing cavity outlet 8; generally, the surface of the annular grinding disc 9 is made into a plane parallel with the axial cross section, so as to simplify the structure; the surface of the annular grinding disc 9 can also be made into a curved surface, so that the surface of the annular grinding disc 9 is at an angle of inclination to the axial cross section; however, the shortcoming is that the difficulty in the manufacturing process is increased.

The annular grinding disc inlet 10 is disposed in the middle part of the annular grinding disc 9; the annular grinding disc inlet 10 is simply disposed in the middle part of the annular grinding disc 9; the foams penetrate through the annular grinding disc inlet 10 under the supercharging action of the supercharged stirring foaming wheel 4; the diameter of the annular grinding disc inlet 10 can be larger than that of the supercharged stirring foaming wheel 4, so that the foams can flow out more smoothly after foaming; the supercharged stirring foaming wheel 4 can penetrate through the annular grinding disc inlet 10 simply by enlarging the inner diameter of the housing cavity 3 at the housing cavity outlet 8; the annular grinding disc 9 can also be used as a part of the housing 1.

The eddy current grinding foaming disc 11 is disposed at one end of the supercharged stirring foaming wheel 4 close to the annular grinding disc 9; the eddy current grinding foaming disc 11 is correspondingly adjacent to the annular grinding disc 9; the eddy current grinding foaming disc 11 is integrated with the supercharged stirring foaming wheel 4; the eddy current grinding foaming disc 11 is disposed at one end of the supercharged stirring foaming wheel 4 close to the annular grinding disc 9; the eddy current grinding foaming disc 11 is correspondingly adjacent to the annular grinding disc 9; the surface of the eddy current grinding foaming disc 11 is corresponding to the surface of the annular grinding disc 9; the surface of the eddy current grinding foaming disc 11 is correspondingly adjacent to the surface of the annular grinding disc 9.

The eddy current grinding foaming cavity 12 is disposed between the surface of the eddy current grinding foaming disc 11 and the surface of the annular grinding disc 9; the surface of the eddy current grinding foaming disc 11 is correspondingly adjacent to the surface of the annular grinding disc 9; a certain space is maintained between the surfaces to form the eddy current grinding foaming cavity 12; the eddy current grinding foaming cavity 12 can be formed between the back surface of the shaft end surface of the eddy current grinding foaming disc 11 and the surface of the annular grinding disc 9 back against the supercharged stirring foaming wheel 4; the supercharged stirring foaming wheel 4 simply penetrates through the annular grinding disc inlet 10 to make the diameter of the eddy current grinding foaming disc 11 exceed that of the supercharged stirring foaming wheel 4; the foaming bubbles are finer and the foaming effect is better if the surface-surface space is smaller; the peripheral linear speed of the eddy current grinding foaming disc 11 is higher and the foaming effect is better if the diameter of the supercharged stirring foaming wheel 4 is larger; the surface of the annular grinding disc 9 is static; the rotary surface of the eddy current grinding foaming disc 11 and the static surface of the annular grinding disc 9 exert an interaction force on the fluid, so that the fluid in the eddy current grinding foaming cavity 12 forms an eddy current; through the eddy current, the melt and the gas are sufficiently ground and mixed, thus realizing eddy current grinding and foaming, and realizing more uniform and finer foams; experiments prove that the space should not be more than 0.5 mm; if it is below 0.5 mm, the foaming effect is better if the space is smaller, and the nano-foam material can be made easily; the rotation of the eddy current grinding foaming disc 11 produces a centrifugal force, so that the foams move towards the periphery of the eddy current grinding foaming disc 11, and can flow more smoothly out of the housing cavity outlet 8.

The structure of the foam material generator with the major structure is simplified, and can be used as a fundamental foam material foaming device. During installation, the transmission shaft 5 can be obliquely placed, so that the bottom inner wall of the housing cavity 3 is gradually elevated towards the housing cavity outlet 8, and the melt can be gathered in the housing cavity inlet 7; thus, the foams with better foaming effect and smaller specific gravity axially move towards the housing cavity outlet 8 under the action of the supercharged stirrers 6 on the supercharged stirring foaming wheel 4, and the melt with poorer foaming effect and larger specific gravity returns back to the housing cavity inlet 7 along the bottom of the housing cavity 3 for continuous foaming. In operation, the housing cavity 3 can be heated to maintain certain temperature inside the housing cavity 3; thus, the foaming effect can be improved, and the equipment can run more stably. A protective cover can also be disposed around the equipment to better ensure safety of operation. The mixing and foaming effects can be improved by the supercharged stirring foaming wheel 4 with higher rotational speed, and materials with smaller foam particles and larger volume expansion ratio can be manufactured. The produced foams can also be delivered into a supercharged conveying unit for output; a heat-resisting screw conveyer can be adopted and can realize extrusion casting; a heating unit can be disposed outside the screw conveyer for thermal insulation and heating, so as to better ensure normal operation of the equipment. The foam material generator can also adopt a graphite material, and can produce foam materials with any material; to relieve high temperature oxidation, nitrogen or carbon dioxide can be used as a foaming gas. The foam material generator can also adopt a heat-resisting ceramic foam material; the equipment cost can be lowered, and the equipment strength and abrasion performance can be improved. During production, heat-resisting tungsten-molybdenum alloy or graphite can firstly be adopted to make a foam material generator; the equipment foams and casts a silicate melt into equipment parts, and a foam material generator of silicate foam material can be produced; a melt resistant to higher temperature, such as aluminium oxide and zirconium oxide is foamed and cast into equipment parts, and a foam material generator of foam materials with higher strength can be produced to resist against higher temperature. The foam material generator of graphite material, using nitrogen or carbon dioxide as foaming gas, can produce a tungsten alloy foam material; the material can be used to produce a heat-resisting fireproof material or heat-resisting mechanical part with low cost; the foam material generator of this material can produce a heat-resisting ceramic foam material such as aluminium oxide and zirconium oxide. The tungsten alloy can be melted through an electric arc furnace, using the graphite material as a furnace lining, and using nitrogen or carbon dioxide for protection.

The structure of the first embodiment of the present invention is as follows: based on the major structure, a thermal insulation device 13 is disposed on the outer wall of the housing cavity 3; the thermal insulation device 13 can cover the outer wall of the housing cavity 3; the thermal insulation device 13 can be made of a heat-resisting thermal insulation material; a protective covering can be disposed on the outermost layer of the thermal insulation device 13; the protective covering can also be used as a safety protection covering; it can simply be filled with a thermal insulation mineral wool; the thermal insulation material layer can also be utilized to improve the leak tightness between the transmission shaft and the housing; the thermal insulation device 13 can prevent heat loss, so as to better ensure that the foam material generator runs properly; a heating unit can also be disposed inside the thermal insulation device 13 for better thermal insulation and heating, so as to better ensure that the foam material generator runs properly; the heating unit can be an electric heating unit or a fuel heating unit; an automatic temperature control device can also be adopted for better temperature control; when the fuel heating unit is adopted, a heating combustion chamber, etc. can be disposed in the thermal insulation device 13.

The foam material generator of this embodiment has all functions of the major structure, and can better ensure that the foam material generator runs properly.

The structure of the second embodiment of the present invention is as follows: based on the foregoing structure, the bottom inner wall of the housing cavity 3 is gradually elevated towards the housing cavity outlet 8; when the foam material generator is installed, the transmission shaft 5 can be obliquely placed, so that the bottom inner wall of the housing cavity 3 can be gradually elevated towards the housing cavity outlet 8, and the melt can be gathered in the housing cavity inlet 7; thus, the foams with better foaming effect and smaller specific gravity axially move towards the housing cavity outlet 8 under the action of the supercharged stirring foaming wheel 4, and the melt with poorer foaming effect and larger specific gravity returns back to the housing cavity inlet 7 along the bottom of the housing cavity 3 for continuous foaming.

The foam material generator of this embodiment has all functions of the foregoing structure, and can improve the foaming effect.

The structure of the third embodiment of the present invention is as follows: based on the foregoing structure, a transmission device position regulating device 14 is disposed between the housing 1 and the transmission device 2; the transmission device position regulating device 14 can be disposed between the housing 1 and the transmission device 2; the transmission device position regulating device 14 can be provided with a screw and a nut, etc.; the transmission device position regulating device 14 can be disposed on a mounting stand of the housing 1; the position of the transmission device 2 can be regulated by regulating the screw and the nut; the nut can be fixed on the mounting stand of the housing 1, while the screw can be regulated; two groups of regulating screws and nuts can be disposed for two-way regulation, so as to regulate the position of the transmission device 2 back and forth; the transmission device position regulating device 14 can regulate the position of the supercharged stirring foaming wheel 4; it can regulate the axial position of the supercharged stirring foaming wheel 4 to better regulate the axial space of the eddy current grinding foaming cavity 12, so that the axial end surface of the supercharged stirring foaming wheel 4 is adjacent to the inner wall of the housing cavity 3, thus better regulating the foaming effect and improving the foaming effect; in operation, a clamp device between the transmission device 1 and the mounting stand of the housing 1 can be released a little under a power-on state; the axial position of the supercharged stirring foaming wheel 4 can be slightly regulated by regulating the regulating screw on the transmission device position regulating device 14; then the clamp device between the transmission device 2 and the mounting stand of the housing 1 is clamped; as the foam material generator works under high temperature, the annular grinding disc 9 and the eddy current grinding foaming disc 11 will expand when heated, or the axial space of the eddy current grinding foaming cavity 12 is changed; the transmission device position regulating device 14 can solve the problem more conveniently; after the foam material generator is used for a long time, the annular grinding disc 9 and the eddy current grinding foaming disc 11 can be worn, thus enlarging the axial distance of the eddy current grinding foaming cavity 12; the axial distance of the eddy current grinding foaming cavity 12 can simply be maintained as an ideal one by properly regulating the transmission device position regulating device 14, thus greatly improving the service life of the equipment.

The foam material generator of this embodiment has all functions of the foregoing structure, and can improve the foaming effect and regulate the foaming effect and the service life of the equipment.

The structure of the fourth embodiment of the present invention is as follows: based on the foregoing structure, a cooling runner device 15 is disposed inside the transmission shaft 5; the transmission shaft 5 can be made into a hollow shaft, inside which the cooling runner device 15 is disposed; the transmission shaft can be cooled by spraying a cooling liquid into the hollow shaft, so as to reduce a material requirement on the transmission shaft; the transmission shaft 5 can be prolonged, so that the two ends of the transmission shaft 5 can penetrate through the transmission device 2 and the housing cavity 3, respectively; thus, the two ends of the transmission shaft 5 stretch out to form a liquid inlet and a liquid outlet, respectively; the cooling runner device 15 can be made with an inlet end area smaller than an outlet end area; the cooling liquid can flow out of the outlet end by making better use of the centrifugal force; the outlet end can be provided with a liquid receiver for receiving the cooling liquid; in this way, the cooling liquid returns back to a cooling device; after cooling, the cooling liquid is forced and sprayed into the transmission shaft 5, thus realizing circular cooling.

The foam material generator of this embodiment has all functions of the foregoing structure, and can reduce a material requirement on the transmission shaft.

The structure of the fifth embodiment of the present invention is as follows: based on the foregoing structure, the housing cavity outlet 8 is provided with a flow regulating device 16; the flow regulating device 16 can adopt a heat-resisting valve or a detachable spout or nozzle with different calibres, etc.; the flow regulating device 16 can better regulate the flow of the foams and the foaming effect.

The foam material generator of this embodiment has all functions of the foregoing structure, and can regulate the flow of the foams and the foaming effect.

The structure of the sixth embodiment of the present invention is as follows: based on the foregoing structure, the housing cavity inlet 7 is provided with an intake flow regulating device 17; the intake flow regulating device 17 can adopt a heat-resisting air hose, valve or ventilation door; at least two housing cavity inlets 7 can be disposed; one housing cavity inlet 7 is used as a melt inlet, while the other housing cavity inlets 7 are used as air inlets; the air inlets are provided with the heat-resisting air hose, valve or ventilation door; when the heat-resisting air hose is disposed, multiple air hoses with different calibres can be disposed; a corresponding air hose can be switched on to regulate the blast capacity according to the need of the blast capacity.

The intake flow regulating device 17 can better regulate the intake blast capacity and the foaming effect. The foam material generator of this embodiment has all functions of the foregoing structure, and can regulate the intake blast capacity and the foaming effect.

The structure of the seventh embodiment of the present invention is as follows: based on the foregoing structure, the surface of the annular grinding disc 9 is at an angle of inclination to the axial cross section; the surface of the eddy current grinding foaming disc 11 is correspondingly adjacent to the surface of the annular grinding disc 9; the surface of the annular grinding disc 9 is made into a taper sleeve structure, so that the surface of the annular grinding disc 9 is at an angle of inclination to the axial cross section; the surface of the eddy current grinding foaming disc 11 is made into a taper surface that is correspondingly adjacent to the surface of the annular grinding disc 9, so that the surface of the eddy current grinding foaming disc 11 is correspondingly adjacent to the surface of the annular grinding disc 9.

The foam material generator of this embodiment has all functions of the major structure, and can regulate the axial space of the eddy current grinding foaming cavity 12 more easily; however, the shortcoming is that the difficulty in the manufacturing process is increased.

The structure of the eighth embodiment of the present invention is as follows: based on the foregoing structure, a ring current grinding foaming wheel 18 is disposed at one end of the supercharged stirring foaming wheel 4 close to the housing cavity outlet 8; the periphery of the ring current grinding foaming wheel 18 is correspondingly adjacent to the inner wall of the housing cavity 3; a ring current grinding foaming cavity 19 is disposed between the periphery of the ring current grinding foaming wheel 18 and the inner wall of the housing cavity 3; the end of the supercharged stirring foaming wheel 4 close to the housing cavity outlet 8 can be made into a cylinder to form a ring current grinding foaming wheel 18; the ring current grinding foaming wheel 18 can be integrated with or separated from the supercharged stirring foaming wheel 4; the periphery of the ring current grinding foaming wheel 18 is correspondingly adjacent to the inner wall of the housing cavity 3; the periphery of the ring current grinding foaming wheel 18 can be correspondingly adjacent to the inner wall of the housing cavity 3; the ring current grinding foaming cavity 19 is disposed between the periphery of the ring current grinding foaming wheel 18 and the inner wall of the housing cavity 3; a certain space is maintained between the periphery of the ring current grinding foaming wheel 18 and the inner wall of the housing cavity 3 to form the ring current grinding foaming cavity 19; the foams are finer and the foaming effect is better if the space is smaller; though being small, the space in the periphery forms a ring runner, whose cross section can provide an adequate flow area for sufficient flow; the foaming effect is better if the axial length of the ring current grinding foaming wheel 18 is longer; the inner wall of the housing cavity 3 is static; the rotary periphery of the ring current grinding foaming wheel 18 and the static inner wall of the housing cavity 3 exert an acting force on the fluid, so that the fluid in the ring current grinding foaming cavity 19 forms a ring current; through the ring current, the melt and the gas are further mixed, thus improving the foaming effect.

The foam material generator of this embodiment can improve the foaming effect.

The structure of the ninth embodiment of the present invention is as follows: based on the foregoing structure, one end of the supercharged stirring foaming wheel 4 is connected with the transmission shaft 5 of the transmission device 2, and the other end of the supercharged stirring foaming wheel 4 is connected with a rotary stabilizing device 20; the rotary stabilizing device 20 can be provided with a bearing, a shaft seat and a support, etc.; the rotary stabilizing device 20 can be disposed on the housing at the other end of the supercharged stirring foaming wheel 4; the transmission shaft 5 can be installed on the rotary stabilizing device 20 after penetrating through the supercharged stirring foaming wheel 4; a power unit can also be disposed on the rotary stabilizing device 20, so that power can be synchronously input from the two ends of the supercharged stirring foaming wheel 4, thus improving power and reducing the stress on the transmission shaft 5; through the rotary stabilizing device 20, the supercharged stirring foaming wheel 4 rotates more stably; the supercharged stirring foaming wheel 4 can realize a longer axial length; the supercharged stirring foaming wheel 4 can also be made into multiple axial flow impellers that are separate in the axial direction; during installation, the impellers are installed together on the transmission shaft, with one staying close to the other.

The foam material generator of this embodiment has all functions of the major structure; the supercharged stirring foaming wheel 4 can rotate more stably, and realize a longer axial length, thus improving the mixing effect of the melt and the gas, and improving the foaming effect; the transmission device 2 can be kept away from the housing cavity 3, thus providing larger space for thermal insulation, and better realizing thermal insulation.

Working principles, application method and using effects: when the foam material generator of the present invention is in use, the transmission device drives the supercharged stirring foaming wheel 4 to rotate, generally with a common rotational speed; the to-be-foamed material is melted into a melt through various methods; before the melt is supplied, a high temperature gas is injected through the housing cavity inlet 7 to heat the foam material generator; the melt and the high temperature gas are supplied synchronously; through the rotation of the supercharged stirring foaming wheel 4, the high temperature gas and the to-be-foamed material melt are automatically sucked into the housing cavity 3 through the housing cavity inlet 7; the supercharged stirring foaming wheel 4 beats the gas into tiny bubble particles, and the high-speed rotation of the supercharged stirring foaming wheel 4 stretches and stirs the melt; the gas and the melt are mixed and stirred in the housing cavity 3 to form foams; the foams axially moves towards the housing cavity outlet 8 under the supercharging action of the supercharged stirrers 6, and are extruded from the eddy current grinding foaming cavity 12; they are further ground, foamed and filtered in the eddy current grinding foaming cavity 12 to form foams with fine bubbles and uniform size and arrangement; the foams are eventually discharged through the housing cavity outlet 8; an eddy current is formed in the eddy current grinding foaming cavity 12; with relative movement, points in the eddy current have an interaction force with each other; fluid molecules in the eddy current have mutual friction, and a rolling friction force is produced; through the eddy current, the bonded molecules or atoms are separated; the particles in the eddy current respectively form a self-moving individual with varying moving speed, and are gradually mixed in the eddy current; the eddy current stretches the melt, and separates the gas into tiny bubble particles; the bubble particles are uniformly distributed in the melt, thus forming foams with uniformly distributed bubble particles; the eddy current grinding foaming disc 11 and the annular grinding disc 9 form a grinding action that uniformly grinds and mixes the melt and the gas. The melt can be stretched into fibres or thin films with multiple singe molecules or atoms connected; the fibres or thin films are interconnected to form foams with bubbles; the wall of the bubbles can be a very thin wall or even be made into a thin film with single molecules or atoms connected. The needed foam material is formed after the foams are cooled and solidified; the foam material can be directly press-rolled, cast and blow-cast, or be made into foam material ingots; it can be rolled into sections by a rolling mill by double heating; annealing can be realized, and material strength can be improved. The foam material generator can greatly improve the foaming efficiency, foaming effect and foaming and foam expansion ratio; various foam expansion ratios can be realized, and the foam expansion ratio can be regulated simply by regulating the supply quantity ratio of the gas and the melt. A high temperature gas is needed to the production of the foam material. A normal temperature gas will largely affect the foaming process; the high temperature melt may rapidly become viscous in the foam material generator, thus affecting the foaming effect; even worse, the equipment may fail, and a shutdown accident may happen. After the foam material generator finishes its work, the high temperature gas is continuously input till remaining foams are all discharged out of the foam material generator. The foam material generator will continuously rotate before it is completely cooled. The foam material generator can produce various foam materials, such as glass, ceramic, steel, alloy, plastic and rubber foam materials. These foam materials have a uniform foam structure. The particle size, quantity and volume fraction of the foams can be controlled easily, and various foam expansion ratios can be realized.

When in use, the foam material generator of the present invention can produce various foam materials according to different requirements by regulating the rotational speed of the foam material generator and the gas supply quantity. The high temperature gas and the material melt are fed into the foam material generator together. The high temperature material melt can be fed into the foam material generator by means of gravity, and the high temperature gas is sucked into the foam material generator. The material melt and the high temperature gas are rapidly mixed and foamed in the foam material generator. When the supply quantity of the high temperature gas and the fluidity and supply quantity of the melt are constant, the bubbles can be more uniform and finer, and the finished foam material can be better if the foam material generator has higher rotational speed and the supercharged stirring foaming wheel 4 has larger diameter. The foam material generator can also be combined with 3D printing technology to directly print various objects. Glass foam materials can be used to make all kinds of furniture; dies can directly be used to make furniture, doors and windows, etc.; the glass foam materials can also be used as decorative materials, thus being more environment-friendly, and being longer in service life. The use of glass as a principal raw material can fully utilize the silicon oxide resource that abounds in nature. The resource will never be short, and no environmental pollution problem will occur.

When the foam material generator is in use or produces foam glass, glass frits having no purity requirement can be produced by melting sand, sandy soil, quartz sand, river sand, rock with low melting point, feldspar, construction waste, coal ash, calcium oxide and sodium carbonate, etc. by using a gas or electric furnace. After the glass frits are melted into the melt by the gas or electric furnace, the melt is fed into the foam material generator. With the foam glass, the weight of a building can be reduced by more than ten times, a hundred times or a thousand times, thus improving the thermal insulation property, permeability, structural strength and shock resistance, etc. of the building; the walls can be drilled, provided with expansion screws or affixed with decorative materials, so as to realize rapid house building. Clean foam glass can be used as lighting glass for a window. Lighting will not be affected. Instead, the thermal insulation property can be improved to exceed the existing thermal insulation glass, thus lowering the cost of the window. The window can be divided into a lighting area and a sight-seeing area. The sight-seeing area can simply adopt the existing sheet glass and vacuum glass. The volume of the glass can be expanded by more than ten times, a hundred times or a thousand times to make ultra-light walls. House parts can be industrialized by using foam glass sections as a frame. Thus, the house can be rapidly spliced, welded and assembled on site, and thus becomes an integrated house that can be erected rapidly, thereby realizing housing construction modularization. The house has many advantages, such as super strength, ultra-light weight, ultra-high thermal insulation effect, super long service life and ultra-high shock resistance. The house can also directly be made into an integrated house by using foam glass. It can directly be carried to the site for lifting, erection and burying. With the house, the construction industry can realize industrialized production. With the use of the foam glass, a higher building can be constructed; a skyscraper above 1,000 m can be built; a building above 3,000 m can be constructed with a conical structure like pyramid. The external wall of the building can be fully utilized for lighting and planting, etc. In this way, a building may become a city, thus realizing a three-dimensional city, and expanding the living space of people. A floating man-made land can be built in an ocean. The land can flow wherever by incorporating a power system. It can move from north to south to make better use of photothermal resources. It can be fixed by anchor lines and will never have an earthquake. The land can be used for planting, production, factory building and city construction, etc., so as to expand the living space of human beings. Foam glass sheets can be laid in an ocean, with a foam glass enclosure erected around. Approximately 1 m thick light soil made of foam glass particles can be laid on the foam glass sheets. 30% of ocean area can be covered, not affecting the earthy environment or moisture cycle. The continents can be connected to separate oceans into multiple small seas. The oceans can be locked, and natural disasters such as tropical storms, hurricanes and tsunamis, etc. can be prevented completely. Houses will become extremely cheap, and the living space of people can be enlarged. Indoor greening can be improved, and the quality of indoor living environment can further be improved. Swimming pools, gymnasiums, recreational areas and gardens, etc. can be constructed indoors, so that people can live in ecological houses with complete functions and have their living quality largely improved. The basement of the house can be buried underground. Thus, the house is planted in the ground, like a timber pile. The house will not collapse even if natural disasters like earthquakes, tsunamis, hurricanes or debris flows occur. Worst of all, the house will slowly topple and fall or be carried away. If it is carried away, it will float in water, and will not cause casualties. During highway and railway construction, no advanced treatment is needed for the roadbed. 10 to 20 cm thick foam glass can be laid on the roadbed after it is evened out and lightly rolled. Foam glass boards that are 50 to 100 m long, 5 to 10 m wide and 0.2 to 0.5 m thick can be produced. The boards can directly be laid on the road surface, thus realizing rapid construction, and improve the road surface quality. The road surface does not need any other materials. The foam glass surface has certain friction coefficient, and the foam glass is an excellent road surfacing material. With the use of the material, dams, ports, polders, bridges and tunnels, etc. can be constructed rapidly, safely and cheaply and with longer service life, thus being modularized and structuralized.

Through the foam material generator of the present invention, a material can become a combination of bubbles and nano-particles. The material will have many nano-material characteristics and many characteristics nano-materials do not have. The foam material generator of the present invention will create an unprecedented magic material, namely nano-foam material. The material performance is better if the bubbles are finer. When the size of the bubble particles is reduced to micrometer, the material becomes a combination of micrometer bubbles and finer nano-particles. The strength of the material can be greatly improved. When the size of the bubble particles is reduced to 1 to 100 nanometers, the material becomes a combination of nano-bubbles and nano-particles. The material has many nano-material characteristics and many characteristics that nano-materials do not have. The material can also be called a gas nano-foam material. The material combines nano-particles of a gas material and nano-particles of a solid material. It can use any gas as a composition, and expand material resources. The material can have varying properties and characteristics by using a same solid material composition but a different gas content ratio and a different gas material composition or using a same gas material composition but a different solid material content ratio and a different solid composition. The varieties of the nano-material can be infinitely increased, and the material performance can be extremely infinitely expanded. Glass made of the material has fine light-admitting quality, and can be used as sheet glass. Besides, as it has the strength as security glass and good thermal insulation performance, it is realistically security insulated nano-glass. A foam material using aluminium oxide or zirconium oxide as a raw material can have higher structural strength and better temperature resistance than the glass material. A computer can compose innumerable information links with 0 and 1. For a nano-foam material with the same material, the gas composition can be considered as 0, while the solid composition can be considered as 1. The combination of the two can create innumerable materials with the same material but different properties and characteristics. Nanocrystallization, light weight and bubbling are inexorable trends of future material development. The nano-foam material, combining a nano-material and a gas material, extremely saves resource consumption, extremely exerts the material performance, extremely realizes material light weight, extremely enlarges the surface area of nano-particles, and extremely improves the surface physical effect of the particles. The material creates new applications in many technical fields, such as computer, electronics, information, superconducting material, laser, optics, catalysis, atom, energy source, photoelectricity, electric power storage, engineering machinery material, spaceflight, inspection, detection, biology and medicine. Nano-foam materials will certainly become leading materials in the world. A foam material or nano-foam material made of a conducting material and a gas that lights after being electrified can be used to produce new lamps, coloured lamps and neon lamps, etc., consuming lower energy than LED lamps. A superconducting material can be produced by using a foam material or nano-foam material that is made of a conducting material and a conducting gas (metallic vapour and ionized gas, etc.). A super-insulating material can be produced by using a foam material or nano-foam material that is made of an insulating material and an insulating gas. A super-shielding material can be produced by using a foam material or nano-foam material that is made of a shielding material and a gas. It can be used to shield magnetic fields, electric fields, electromagnetic radiation and nuclear radiation, etc. During foaming, graphite powder can be added to produce a self-lubricating material; liquid copper can be added to produce a material with sterilizing copper ions; fluorescent powder can be added to produce a luminescent material. Nano-foam materials can be used to produce new luminescent materials, laser materials, ferromagnetic materials, magnetic conductive materials, heat conductive materials, thermal insulation materials, wear-resistant materials, self-lubricating materials, grinding materials and catalytic materials, etc. A lot of materials with advantages, such as high hardness, high tenacity, high elasticity, high strength, wear resistance, temperature resistance, thermal insulation, radiation shielding, insulation, sound insulation, corrosion resistance and aging resistance, can be created.

When the foam material generator produces a foam material, the material maintains a uniform structure when its volume is expanded for more than ten thousand times. The material will form a grid structure of linear connection inside. The linear fineness of connection can reach or exceed a nano-level. Voids inside the material are interconnected grid structures, rather than foaming structures. The material has many characteristics that foam materials do not have. It is a new material, which may be defined as a grid material or nano-grid material. The material has better elasticity, tenacity, thermal insulation performance and moisture retention performance, and many special and unknown material properties. The material can extremely save material utilization amount and expand material properties. It can be used to make high performance thermal insulation materials, water retention materials, water infiltration materials, filter materials, elastic materials, transmitting materials, protective materials, penetrating materials, active materials, microbiological culture medium materials and battery electrode plate materials, etc. The glass material has good water permeability, and can absorb air and water vapour, and can well prevent evaporation of water. Thus, it can be used for ground coverage, and can well realize thermal insulation and moisture retention. When the material is used for ground coverage for crop cultivation, it can preserve heat, retain moisture, extirpate weeds, improve microbial activity in soil, improve soil nutrient conversion, and realize no-tillage crop cultivation in soil. Besides, organic matters from rotted crop straws, branches and leaves, as well as organic fertilizers and chemical fertilizers, can penetrate into soil under the material, preventing fertilizer deficiency for soil. Irrigation volume of soil can be reduced. Spray irrigation, drop irrigation and other water-saving irrigation methods can be adopted. Puncture fertilization can be adopted, that is, a pointed fertilizer applicator punctures into soil for fertilization. When the material takes the place of plastic films to build a greenhouse, the greenhouse can realize better thermal insulation, lighting and rain leakage, as well as low cost and ultra-long span, and can largely improve greenhouse cultivation mechanization. The greenhouse can realize protected cultivation on a vast land, extremely utilize the natural light source, realize a large-area greenhouse on the land, realize large-area protected cultivation and facility cultivation of crops, largely improve crop yield, and extremely improve agricultural benefits. Meanwhile, the greenhouse can be used as a dwelling house, thus realizing a realistically pastoral house, and helping people truly return to nature. The material can also be used for desert coverage. Covering with 1 to 10 mm thickness material can achieve thermal insulation and moisture retention effects. Film mulching can be adopted. The coverage cost is rather low. A desert can be covered rapidly and completely with minimal material. Moving dunes can be fixed thoroughly, and thorough sand fixation can be realized, thus wiping out sand storms. Holes can be dug in the coverage material to plant trees and desert plants, so that vegetation can be created in the desert, and the desert can become an oasis and forest. The material can be used for ground coverage, and can really bring water and soil under control. When it is used to cover steep hills with serious water and soil loss, water and soil can be protected from being lost, and vegetation recovery can be promoted. The material can be made into a spherical lump shape to form a microbiological culture medium. A microbiological culture hotbed can be formed on the inner surface of the bubbles. Thus, the material can better culture microbial colonies, and can be applied in various fields, such as biological fermentation and sewage treatment, where a large number of colonies are needed. The material can be made into particles, which will be mixed into soil to form a water retaining agent. The water retaining agent can well absorb water, store water, regulate soil water content, regulate the granular structure of soil, improve microbial activity in soil, improve soil fertility, improve soil, and largely improve crop yield, which can go up for more than 30% by conservative estimation. The material can also be used to make light soil, and can be widely used for soil coverage greening, crop cultivation, soilless cultivation and horticultural gardening, etc. The material can also be used for grassland ground coverage or be mixed into soil for soil improvement, so as to preserve moisture and fertility, and improve grass yield. The material can also be used for desert soil improvement. It can be mixed into sandy soil to form a water retention layer serving for water and heat preservation; the material can better help plant growth. To fix a moving dune, a square grid isolating circle can be made using the foam glass; the material is mixed into sandy soil within the isolating circle, and plants can be grown. In this way, a desert can become an oasis.

When the foam material generator produces foam materials, the produced foam glass sections has good tenacity, elasticity, mechanical strength, heat expansion stability and thermal shock resistance, and can be rolled, cut, machined, drilled, polished, painted, bonded and welded. Multiple welding methods can be adopted, like laser welding and high-temperature gas baking welding, etc. The existing glass welding techniques can also be adopted. The foam glass can be used for the making of houses, furniture, doors and windows, floors, decorative materials, mechanical parts, pipes, aerospace materials and insulated leathers (never to age) of electric wire, etc. The foam glass sections can completely weed out structural steel sections. The foam glass used as a wallboard can realize foam glass structural fabrication for a house. The wallboard can be welded with the sections, thus largely improving overall structural strength. The foam glass can be a good floor and wall paving material and can be used as a floor, a floor tile or a wall tile after its surface is polished. The surface of the foam glass can be glazed to produce a new ceramic product. Foam glass doors and windows can have better thermal insulation performance, and a longer service life than aluminium alloy doors and windows or long lasting durability. Foam glass fibres produced by the foam material generator have better tenacity and elasticity. They can be used to make various shell fabrics, and used as decorative materials, garment materials, industrial materials and inorganic paper, etc. Thus, they can be more environment-friendly, and can largely save the utilization amount of biological and natural resources such as timbers, and better protect the environment. The inorganic paper can permanently preserve paintings and calligraphies and record civilizations. It has better performance when used as a decorative material or wallpaper.

When the foam material generator produces a foam glass material or a foam glass fibre material, the foam glass performance can further be changed by other compositions added to the raw materials of the foam glass. Garment materials and thermal wears made of various foam fibres produced by the foam material generator have better thermal insulation performance and lighter weight. Foam ceramics and foam refractory materials made of heat-resisting materials such as ceramic materials and tungsten alloy have better temperature resistance and thermal insulation performance as well as higher structural strength, and can be used for mechanical manufacture, engines and refractory materials, etc. The cost of cars made of foam glass materials can be largely lowered. When a nano-foam glass material with a volume expansion ratio of 10 to 100 times is used to make the car body and window glass, etc. or a car, and a foam glass material with a volume expansion ratio of 1,000 to 10,000 times is used to make the interiors, tyres and seats, the weight of the car can be largely reduced. If hydrogen, helium or water vapour is used as a foaming gas, the weight of the car can further be reduced, even to zero weight. The car body strength can have the effect of an armoured car; a better mute effect can be realized; the driving energy consumption can be largely lowered; the tyres can be widened substantially; a guiding device can be added; and the manoeuvrability and safety performance of the car can be improved substantially. The tyres can be made with solid elastic foam glass materials, so as to completely eradicate tyre burst. The insulated leathers of wires, interiors and seats in the car are all made of foam glass materials, so that the car will never age, and the service life of the car can be greatly prolonged. The outside shell of the car body does not need to be painted. The interiors and outside shell of the car body can simply be waxed to keep the car look new as before. Minor rubbing can not have the car damaged. As the car body is rather light and the car body strength and elasticity are very high, the collision resistance, crash resistance, acceleration and brake capabilities as well as safety performance of the car are largely improved. Cars can be parked more conveniently and rapidly as they can be moved and placed artificially and randomly like bicycles. If not overloaded, an aircraft made of foam materials can slowly float to the ground like a parachute in case the engine is flamed out in the air, thus completely eradicating the happening of air disasters. Foam materials can be widely used for aircraft manufacturing. Helium or high-temperature water vapour can be used as a foaming gas to produce a floating material that is lighter than air. The material can float in the air like balloons. An aircraft made of the material can save more energy, and can fly like an airship and serve as a real airship. A house made of the material can float in the air. It can be stabilized by an anchor line on the ground, so that a real castle in the air can be constructed, people can live in the air, and natural disasters like earthquake and tsunami can be completely prevented, thus largely expanding the living space of human beings. The material can also be used to build meteorological stations, television transmitting stations, signal towers, radar platforms, navigation stations, observatories, sightseeing stations and space launch platforms that float in the air.

When the foam material generator is used as foam material production equipment, foam materials will become leading materials in the world, and will change the whole world. Most man-made materials can be bubbled, thus largely saving raw material amount and saving resources. The silicon oxide resource that abounds in nature can be fully utilized, so that a great number of low-cost, environment-friendly and high-quality materials can be obtained, and the material resources can become very sufficient. Silicon oxide can become a leading basic material with most extensive use, and foam glass can become a leading material, thus thoroughly solving the material resource problem. All things on earth are made up of materials. The production of new materials will create a new world. The ages of human civilization are defined by leading materials that are used.

Steel has always been a leading material throughout the ages of human civilization, ranging from the Stone Age, the Bronze Age and the Iron Age to this day. Today is still in the Iron Age. When nano-foam glass is applied largely, human civilization will enter into a new age, namely Foam Glass Age. Human civilization will reach a higher level, and a new age of civilization will begin.

The technical scheme of the present invention is not limited to the embodiments described herein. Those not described in detail in the present invention shall be a prior art.

What is claimed is:

1. A foam material generator, comprising a housing and a transmission device, wherein the transmission device is disposed on the housing; a housing cavity is disposed in the housing; a supercharged stirring foaming wheel is disposed in the housing cavity; a transmission shaft of the transmission device is connected with the supercharged stirring foaming wheel; the supercharged stirring foaming wheel is provided with multiple supercharged stirrers; the windward side of the supercharged stirrers is at an angle of inclination to the rotary axial cross section of the supercharged stirring foaming wheel; a housing cavity inlet is disposed at one end of the housing cavity, and a housing cavity outlet is disposed at the other end of the housing cavity; an annular grinding disc is disposed on the inner wall of the housing cavity close to the housing cavity outlet; an annular grinding disc inlet is disposed in the middle part of the annular grinding disc; an eddy current grinding foaming disc is disposed at one end of the supercharged stirring foaming wheel close to the annular grinding disc; the surface of the eddy current grinding foaming disc is correspondingly adjacent to the surface of the annular grinding disc; and an eddy current grinding foaming cavity is disposed between the surface of the eddy current grinding foaming disc and the surface of the annular grinding disc.

2. The foam material generator according to claim 1, wherein a thermal insulation device is disposed on the outer wall of the housing cavity.

3. The foam material generator according to claim 1, wherein the bottom inner wall of the housing cavity is gradually elevated towards the housing cavity outlet.

4. The foam material generator according to claim 1, wherein a transmission device position regulating device is disposed between the housing and the transmission device.

5. The foam material generator according to claim 1, wherein a cooling runner device is disposed inside the transmission shaft.

6. The foam material generator according to claim 1, wherein the housing cavity outlet is provided with a flow regulating device.

7. The foam material generator according to claim 1, wherein the housing cavity inlet is provided with an intake flow regulating device.

8. The foam material generator according to claim 1, wherein the surface of the annular grinding disc is at an angle of inclination to the rotary cross section; the surface of the eddy current grinding foaming disc is correspondingly adjacent to the surface of the annular grinding disc.

9. The foam material generator according to claim 1, wherein a ring current grinding foaming wheel is disposed at one end of the supercharged stirring foaming wheel close to the housing cavity outlet outlet; the periphery of the ring current grinding foaming wheel is correspondingly adjacent to the inner wall of the housing; cavity; a ring current grinding foaming cavity is disposed between the periphery of the ring current grinding foaming wheel and the inner wall of the housing cavity.

10. The foam material generator according to claim 1, wherein one end of the supercharged stirring foaming wheel is connected with the transmission shaft of the transmission device, and the other end of the supercharged stirring foaming wheel is connected with a rotary stabilizing device.

* * * * *